United States Patent [19]

Beier et al.

[11] 4,314,802

[45] Feb. 9, 1982

[54] PROCESS FOR PRODUCING LEATHER

[75] Inventors: William C. Beier, Short Hills, N.J.; James J. Hodder, Doylestown, Pa.

[73] Assignee: Rohm and Haas Company, Philadelphia, Pa.

[21] Appl. No.: 69,470

[22] Filed: Aug. 24, 1979

[51] Int. Cl.[3] ..... C14C 3/06; C14C 1/08; C14C 3/22; C14C 3/28

[52] U.S. Cl. ..... 8/94.26; 8/94.19 R; 8/94.19 C; 252/8.57; 428/473

[58] Field of Search ..... 8/94.19 R, 94.19 C, 8/94.26; 428/473

[56] References Cited

U.S. PATENT DOCUMENTS

| | | | |
|---|---|---|---|
| 2,826,477 | 3/1958 | Rau et al. | 8/94.26 |
| 3,408,319 | 10/1968 | Rau | 260/29.6 H |
| 3,519,378 | 7/1970 | Luck et al. | 8/94.26 |

OTHER PUBLICATIONS

Derwent Abs. 26117 [DL-133-687] Jan. 17, 1979 "Leather for Shoe Uppers . . . ".

Derwent Abs. 34850 [SU561-733] Aug. 25, 1977, "Leather Prod. from Hides . . . ", [equivalent C. Abs. 871103388h-Zurabyan et al.].

Chem. Abs., vol. 88: 171813, "Tanning of Shoe Sole Leathers . . . ", Shapirov et al.

*Primary Examiner*—Joseph L. Schofer
*Assistant Examiner*—Herbert J. Lilling
*Attorney, Agent, or Firm*—Lester E. Johnson

[57] ABSTRACT

This invention relates to an improved process for producing a tanned heavy leather, sometimes called full thickness leather, suitable for use for shoe soles, belts and straps, bags and cases, and saddles, bridles, and harness, wherein, under carefully controlled pH conditions, leather stock is subjected to a multiple-stage tanning process involving a first treatment with an aqueous dispersion or solution of a synthetic polymeric composition made by polymerizing at least one member selected from the group consisting of acrylic acid and methacrylic acid and, optionally, one or more polymerizable compounds selected from the group of alkyl esters of acrylic acid, alkyl esters of methacrylic acid and sulfated unsaturated drying oils, followed by a second treatment with a zirconium tanning compound having a 0-45% basicity by the Schorlemmer scale.

12 Claims, No Drawings

PROCESS FOR PRODUCING LEATHER

BACKGROUND OF THE INVENTION

1. Field of the Invention

This invention relates to an improved process for producing a tanned leather suitable for use for shoe soles, belts and straps, and bags and cases.

2. Description of the Prior Art

It is already known that various hides and skins can be tanned by the application of a variety of tanning agents including vegetable tanning compositions, mineral tanning agents such as chrome and zirconium tanning compounds, and synthetic tanning compositions (syntans). While vegetable tanning compositions are satisfactory for producing a variety of tanned leather products, such as sole leather from steer hides, upholstery and garment leather from cow hides, and glove leather from calf skin and the like, there is yet a need in the art for improved leather products, and methods for making the same, having improved abrasion resistance, diminished amount of water-extractable substances, improved strength properties, greater ease of fabrication, improved chemical resistance, elimination of the use of toxic tanning substances such as natural tanning extracts and phenolic tanning agents, and shorter tanning time.

Zirconium salts such as those disclosed in U.S. Pat. No. 2,826,477 to Rau and Somerville have been used to overcome some of the disadvantages previously known to be associated with the use of zirconium tanning agents.

Acrylic tanning agents, while suitable for many purposes, have the disadvantage of imparting brittleness and crackiness to the grain of the leather and of giving variable penetration of the tanning agent into the hide tanned therewith. U.S. Pat. No. 3,408,319 to Rau discloses the improvement in the use of synthetic acrylic polymeric tanning compositions containing units from acrylic acid and methacrylic acid and mixtures thereof wherein the disadvantages of imparting brittleness and crackiness to the grain of the leather are overcome by the use of a tanning composition made by copolymerizing acrylic acid, methacrylic acid, or mixtures thereof with a sulfated unsaturated drying oil. At column 3, lines 21–22 of the patent there appears the broad disclosure, referring to the tannage using the compounds of the patent, "This tannage may be followed by a mineral tanning, vegetable tanning, or synthetic tanning agent." Illustrative procedures 2, 4, 6 and 10 which appear in columns 3–5 of the patent exemplify the tannage of pickled calfskin to obtain white leather product using a synthetic copolymeric tanning composition disclosed in the patent as the single tanning agent. Illustrative procedure 8 exemplifies the pretannage of pickled calfskin with a synthetic copolymeric tanning composition of the patent followed by a tannage with basic zirconium sulfate. However, it is known in the leather tanning art that relatively thin calfskin tanned as set forth in illustrative procedure 8 of the patent, while suitable for use in making leathers requiring relatively narrow thickness such as lightweight dress shoe upper leather, would not be suitable for making leather articles requiring relatively broad thickness from thicker hides, such as sole leather from steer hides.

V. S. Shapirov et al., Kozh.-Obuvn. Prom-st., 20(3), 29–30 (1978); Chem. Abs., 88:171813p (1978), broadly disclose the tanning of shoe sole leathers using titanium-zirconium tanning compounds wherein the resulting products, optionally, may be further treated with syntans.

K. M. Zurabyan et al., USSR Pat. No. 561,733; Chem. Abs., 87:103388h (1977), disclose a process for beamhouse treatment and tanning of hide shoulders wherein the tanning involves the initial use of a chrome tanning composition followed by the use of an organic tanning agent. A rough translation of the Russian indicates that a vegetable tanning agent having phenolic components is used as the organic tanning agent.

It is conventional in the art of tanning leather to produce leather suitable for use in making shoe soles, belts and straps, and bags and cases by tanning hides with vegetable tanning compositions and, optionally, using mineral tanning agents and/or syntans in the final stages of the tanning process.

It is an object of the present invention to provide an improved process for tanning heavy leather, sometimes called full thickness leather, suitable for use for making shoe soles, belts and straps, bags and cases, and saddles, bridles and harness, whereby the leather product is characterized by an advantageous combination of, and an overall improvement in, properties not obtainable by processes heretofore known, such as a combination of improvements in appearance, fullness, firmness, flexibility, resilience, abrasion resistance, tensile strength, ease of fabrication and processing, water absorption, shrinkage temperature, content of water-extractable substances, chemical resistance, light-fastness, and density. It is another object to provide an improved tanned leather product produced by the process of the invention. It is yet another object to provide, as an article of manufacture, a shoe sole, belt, strap, bag, or case made from the tanned leather product produced by the process of the invention.

These and other objects as will become apparent to those skilled in the art are achieved by the present invention which comprises a multiple-stage tanning process for producing a tanned leather suitable for use for shoe soles, belts, straps, bags and cases, comprising the steps, carried out in a series of aqueous tanning baths, of:

(1) providing a piece of wet leather stock selected from the group consisting of pickled leather stock, bated leather stock, and limed leather stock;

(2) adjusting the pH of the leather stock provided in step (1) to obtain a pH of the leather stock in the range of 4.5–5.5;

(3) treating the leather stock from step (2), while maintaining the pH thereof at 4.5–5.5, with 1–50% by weight, based on the initial wet weight of the leather stock, of a first tanning composition comprising an aqueous dispersion or solution of a polymer polymerized from a monomer mixture comprising at least one member selected from the group consisting of acrylic acid, methacrylic acid, mixtures of acrylic acid and methacrylic acid, and mixtures of a major proportion of at least one member selected from the group consisting of acrylic acid and methacrylic acid with a minor proportion of at least one member selected from the group consisting of alkyl esters of acrylic acid, alkyl esters of methacrylic acid, and partially sulfated unsaturated drying oils, until the leather stock is penetrated therewith;

(4) adjusting the pH of the leather stock from step (3) to 1.5–3.3 to exhaust the first tanning composition and to obtain an optimal pH for the subsequent second tanning treatment;

(5) treating the leather stock from step (4), while establishing and maintaining the pH thereof at 1–3.3, with 5.5–20% by weight, based on initial wet weight of leather stock, of a second tanning composition comprising a zirconium tanning compound having 0–45% calculated on the Schorlemmer scale, the amount of zirconium tanning compound being sufficient to provide an amount of zirconium calculated as the oxide of about 1.8–6.6% by weight, based on the initial wet weight of the leather stock, until the leather stock is tanned to the desired extent;

(6) neutralizing the tanned leather stock from step (5) to a pH of 3.5–5 by the addition to the tanning bath of an aqueous solution of a weak base; and (7) washing the tanned leather stock from step (6) with water, optionally further treating the washed tanned leather stock with conventional adjuvants, and drying the tanned leather stock in conventional operations.

In another aspect, the invention comprises an improved tanned leather product produced by the process of the invention.

In yet another aspect, the invention comprises, as an article of manufacture, a shoe sole, belt, strap, bag or case made from the tanned leather product produced by the process of the invention.

It has been unexpectedly and surprisingly discovered that, under carefully controlled pH conditions in the various stages of the tanning process, leather stock can be subjected to a multiple-stage tanning process wherein the leather stock is first tanned, in an otherwise conventional operation, with a known tanning composition comprising an aqueous dispersion or solution of a polymeric tanning agent polymerized from a monomer mixture comprising 100% or at least a major proportion of at least one of acrylic acid, methacrylic acid, or mixtures thereof and, optionally, one or more monomers selected from the group consisting of alkyl esters of acrylic acid, alkyl esters of methacrylic acid, and partially sulfated unsaturated drying oils, followed by a second tannage, or retannage, in an otherwise conventional operation, with a known mineral tanning composition, especially a zirconium tanning compound having 0–45%, preferably about 0%, basicity on the Schorlemmer scale.

The term "leather stock" is used herein to mean animal hide or skin that has been conventionally limed, bated or pickled. The amounts and percentages of materials used in the process of the invention are adjusted within the ranges set forth to account for the difference in water content of the particular leather stock used.

The leather stock used in the process of the invention may be derived from any known animal hide or skin. The hides may be bovine or equine hides and the skins may be ovine skins, goat skins, and pig skins. Preferably, bovine hides are used in the process of the invention. Most preferably, steer hides are used in the process of the invention.

The first tanning composition used in the process of the invention, applied to or contacted with the leather stock while maintaining the pH thereof at 4.5–5.5, preferably 4.7–5.2, as an aqueous dispersion or solution by operations well-known in the art, may be any of the polymers or copolymers polymerized from a monomer mixture selected from the group consisting of acrylic acid, methacrylic acid, mixtures of acrylic acid and methacrylic acid, and mixtures of a major proportion of at least one of acrylic acid and methacrylic acid and a minor proportion of at least one member selected from the group consisting of alkyl esters of acrylic acid, alkyl esters of methacrylic acid and partially sulfated unsaturated drying oils. The terms "major" and "minor" are used herein to mean greater than 50% and less than 50%, by weight of monomer mixture, respectively. Preferably, the first tanning composition comprises a copolymer of acrylic acid or methacrylic acid or a mixture thereof with at least one partially sulfated unsaturated drying oil, this tanning composition being of the type disclosed in U.S. Pat. No. 3,408,319 to Rau mentioned hereinabove, the disclosure of which as it relates to the preparation and use of the tanning compositions is incorporated herein by reference. This first tanning composition is used in an amount of 1–50%, preferably 3.5–10%, by weight, based on the weight of initial wet leather stock. The leather stock is contacted with this first tanning composition until the leather stock is completely penetrated therewith.

The second tanning composition used in the process of the invention, applied to or contacted with the leather stock from the first tanning operation, while establishing and maintaining the pH thereof at 1–3.3, preferably 1.5–2, by operations well known in the art, may be any mineral tanning composition, preferably any zirconium tanning compound having 0–45%, preferably about 0%, basicity on the Schorlemmer scale. The preferred zirconium tanning compound is used in amounts sufficient to provide an amount of zirconium calculated as the oxide of about 1.8–6.6%, preferably 2.3–6.6%, by weight, based on the initial wet weight of the leather stock. The leather stock obtained from the first tanning operation is contacted with the second tanning composition until the desired extent of tanning is obtained.

By adhering to the critical limitations of pH conditions and following the sequence of tanning operations set forth above, a tanned leather product suitable for use in making shoe soles, belts and straps, and bags and cases is produced which has an overall combination of performance properties that is superior to those obtained in tanned leather products produced by conventional vegetable tanning operations.

For the purpose of tanning leather stock, the first tanning agent used in the invention is dissolved in water at a concentration of about 5–40% by weight. Of course, the polymer need not be isolated from the aqueous dispersion or solution in which it is prepared. Such dispersions or solutions need only be adjusted to the desired concentration for use in tanning. A salt, such as sodium chloride or sodium sulfate, along with a suitable buffer system, both in conventional amounts, are included in the first tanning agent dispersion or solution, thereby obtaining the first tanning composition. This first tanning composition is provided in any suitable vessel, such as a conventional tanning drum or bin or vat, in an amount sufficient to provide 1–50% by weight preferably 3.5–10%, thereof, based on initial weight of wet leather stock. It is to be understood that the amount of first tanning composition may vary depending on whether pickled, or bated, leather stock is used in the first tanning operation. This first tanning operation is effected in a conventional manner by agitating or tumbling the leather stock in the tanning vessel at a conventional temperature for about 4–24 hours. Sufficient acidic material, such as sulfuric acid, is then added to the tanning bath (or liquor) containing the leather stock and the resulting mixture is agitated further until the first tanning composition is exhausted, whereby the first tanning agent is maximally combined, or "set," in the leather stock.

Then, the second tanning composition, preferably the zirconium tanning compound, is added in one or more portions to the vessel containing the leather product from the first tanning operation. This second tanning is effected by agitating the vessel in a conventional manner for the length of time required to obtain the desired extent of final tanning.

The product from the second tanning operation is then neutralized to a pH of about 3.5–5, about the natural or isoelectric pH of the leather stock, by adding to the second tanning vessel containing the leather stock a dilute aqueous solution of a mild, or weak, base such as, for example, sodium bicarbonate.

The fully-tanned leather stock is then thoroughly washed with water, optionally further treated with oil and moldicides, and finally dried in conventional operations preparatory for subsequent processing.

To assist those skilled in the art to practice the present invention, the following mode of operation is illustrative of the practice of the invention, all parts and percentages being by weight unless otherwise specified.

A whole, pickled stock steer hide of full thickness, having a pH of about 1.5–1.75, is provided in a tanning vessel. To this there is added 200% by weight, based on the wet weight of initial stock steer hide, of an aqueous, buffered, mild (or weak) alkaline solution containing 10% by weight of the solution of sodium chloride, 6% by weight of the solution of Borax®, and 1% by weight of the solution of sodium acetate. This mixture is agitated for a period of about 5 hours and then stored overnight (about 15 hrs.). Following this treatment, the penetration of the hide by the buffered alkaline solution is 100%, the pH of the stock hide is about 4.75, and the pH of the tanning bath (or liquor) is about 6.5.

Next, there is added to the tanning vessel a solution containing 7.5%, based on the wet weight of the initial stock steer hide, of a 40% solids solution of a polymeric tanning composition wherein the polymer is polymerized from a monomer mixture comprising about 90 parts by weight of methacrylic acid and about 10 parts by weight of sulfated castor oil produced by the procedure described in U.S. Pat. No. 3,408,319 to Rau mentioned above. The mixture is agitated for about 2 hrs. until the tanning composition completely penetrates the leather stock while maintaining the pH of the leather stock at about 4.75–5 and the pH of the tanning bath (or liquor) at about 4.8.

Then, there is added to the tanning bath about 1.5%, based on the wet weight of the initial stock steer hide, of sulfuric acid whereby the pH of the liquor is adjusted to about 2.8, thereby exhausting the first polymeric tannage and providing an optional pH for the subsequent second tanning treatment.

Following this, there is added to the tanning bath 12% by weight, based on the wet weight of the initial stock steer hide, in three equal portions, of a zirconium sulfate tanning compound containing 33% by weight of zirconium caculated as the oxide with sufficient sulfuric acid to obtain the corresponding zirconium salt having about 0% basicity on the Schorlemmer scale, the pH of the partially tanned stock steer hide being maintained at 1.5–1.75 and the pH of the tanning bath (or liquor) being maintained at about 1.2. The resulting mixture is agitated for about 2 hrs. and then stored overnight (about 15 hrs.) whereupon 100% penetration of the partially-tanned stock steer hide by the second, zirconium tanning composition is achieved.

Then, the second, finally-tanned leather stock is neutralized to about the isoelectric pH of this leather by the addition, with agitation, to the tanning bath of 8%, based on the wet weight of initial stock steer hide, of aqueous sodium bicarbonate solution in feeds containing 0.5% sodium bicarbonate repeated at 15 min. intervals. Following the last of these feeds, the neutralized tanning mixture is agitated for an additional hour whereupon the finally-tanned steer hide has a pH of 3.75–4.25 and the tanning bath (or liquor) has a pH of about 4.

The finally-tanned steer hide is then thoroughly washed with water, treated with oil and a moldicide, and crust dried in conventional operations. This product is now prepared for subsequent processing to produce shoe soles, belts, straps, bags and cases.

The performance properties of this fully-tanned, white leather product produced by the illustrative process of the invention, qualitatively evaluated by comparison to the corresponding properties of steer hide leather tanned by a conventional vegetable tanning process, are set forth in the tabular listing which follows:

| Property | Evaluation |
|---|---|
| appearance | = |
| fullness (plumpness) | = |
| firmness | = |
| flexibility/resilience | = |
| abrasion resistance | +++ |
| tensile strength | = |
| ease of fabrication | = |
| water absorption | ++ |
| water extraction | +++ |
| chemical resistance | ++++ |
| light-fastness | ++++ |
| density | ++ |

= indicates comparable performance + indicates one degree of improvement in performance
++ indicates two degrees of improvement in performance
+++ indicates three degrees of improvement in performance
++++ indicates four degrees of improvement in performance The listing above shows that the process of the invention provides a leather product having appearance, fullness, firmness, flexibility, tensile strength, ease-of-fabrication and water adsorption properties comparable to those obtained by a conventional vegetable tanning agent-tanned leather product. There is obtained by the process of the invention a leather product having about two degrees of improvement in density compared to vegetable tanned leather. The leather product obtained by the invention possesses three degrees of improvement in abrasion resistance, and water extraction (loss of weight due to removal of water-soluble components on extraction with water) when compared to leather produced by a conventional vegetable tanning process. And, there is obtained in the leather product produced by the process of the invention four degrees of improvement in chemical resistance and light-fastness when compared to the corresponding properties of leather produced by a conventional vegetable tanning process. Accordingly, the process of the invention provides a leather product having superior qualities when compared to leather obtained by conventional processes.

What is claimed is:

1. A multiple-stage tanning process for producing an improved, tanned, heavy leather, comprising the steps, carried out in a series of aqueous tanning baths, of:

(1) providing a piece of wet leather stock selected from the group consisting of pickled leather stock, bated leather stock, and limed leather stock;

(2) adjusting the pH of the leather stock provided in step (1) to obtain a pH of the leather stock in the range of 4.5–5.5;

(3) treating the leather stock from step (2), while establishing and maintaining the pH thereof at 4.5–5.5, with 1–50% by weight, based on the initial wet weight of the leather stock, of a first tanning composition comprising an aqueous dispersion or solution of a polymer polymerized from a monomer mixture comprising at least one member selected from a group consisting of acrylic acid, methacrylic acid, mixtures of acrylic acid and methacrylic acid, and mixtures of a major proportion of at least one member selected from the group consisting of acrylic acid and methacrylic acid with a minor proportion of at least one member selected from the group consisting of alkyl esters of acrylic acid, alkyl esters of methacrylic acid, and partially sulfated unsaturated drying oils, until the leather stock is penetrated therewith;

(4) adjusting the pH of the leather stock from step (3) to 1.5–3.3 to exhaust the first tanning composition and to obtain an optimal pH for the subsequent second tanning treatment;

(5) treating the leather stock of step (4), while establishing and maintaining the pH thereof at 1–3.3, with 5.5–20% by weight, based on the initial wet weight of the leather stock, of a second tanning composition comprising a zirconium tanning compound having 0–45% basicity calculated on the Schorlemmer scale, the amount of the zirconium tanning compound being sufficient to provide an amount of zirconium calculated as the oxide of about 1.8–6.6% by weight, based on the initial wet weight of the leather stock, until the leather stock is tanned to the desired extent;

(6) neutralizing the tanned leather stock from step (5) to a pH of 3.5–5 by the addition to the tanning bath of an aqueous solution of a weak base; and (7) washing the tanned leather stock from step (6) with water, optionally further treating the washed tanned leather stock with conventional adjuvants, and drying the tanned leather stock in conventional operations.

2. The process of claim 1 wherein the leather stock is selected from the group consisting of equine hides, bovine hides, ovine skins, goat skins, and pig skins.

3. The process of claim 2 wherein the leather stock is bovine hide.

4. The process of claim 3 wherein the leather stock is steer hide.

5. The process of claim 1 wherein the first tanning composition is provided in an amount of 3.5–10% by weight, based on the initial wet weight of the leather stock, and comprises an aqueous dispersion or solution comprising 5–40% by weight of dispersion or solution of a polymer polymerized from a monomer mixture comprising 80–90 parts by weight of at least one member selected from the group consisting of acrylic acid and methacrylic acid and a 20–10 parts by weight of at least one member selected from the group consisting of partially sulfated drying oils and wherein the second tanning composition is provided in an amount of 7–20% by weight, based on the initial wet weight of the leather stock, and comprises a zirconium tanning compound having about 0% basicity, the amount of zirconium tanning compound being sufficient to provide an amount of zirconium calculated as the oxide of about 2.3–6.6% by weight, based on the initial wet weight of the leather stock.

6. The process of claim 5 wherein the leather stock is steer hide, the first tanning composition comprises 7.5% by weight of a 40% solids aqueous solution of a polymer polymerized from a monomer mixture comprising about 90 parts by weight of methacrylic acid and about 10 parts by weight of sulfated castor oil, and the second tanning composition comprises 12% by weight of a zirconium sulfate tanning compound containing 33% of zirconium calculated as the oxide.

7. An improved tanned leather product produced by the process of claim 1.

8. An improved tanned leather product produced by the process of claim 5.

9. An improved tanned leather product produced by the process of claim 6.

10. An article of manufacture, in the form of a shoe sole, belt, strap, bag, saddle, bridle, harness, or case, made from the product produced by the process of claim 1.

11. An article of manufacture, in the form of a shoe sole, belt, strap, bag, saddle, bridle, harness, or case, made from the product produced by the process of claim 5.

12. An article of manufacture, in the form of a shoe sole, belt, strap, bag, saddle, bridle, harness, or case, made from the product produced by the process of claim 6.

* * * * *